United States Patent [19]

Hammes

[11] 4,228,911

[45] Oct. 21, 1980

[54] ROLLER CHIMES FOR CLOSED HEAD DRUMS

[75] Inventor: Theo Hammes, Cologne, Fed. Rep. of Germany

[73] Assignee: Mauser-Kommandit Gesellschaft, Bruhl, Fed. Rep. of Germany

[21] Appl. No.: 955,616

[22] Filed: Oct. 30, 1978

[30] Foreign Application Priority Data

Apr. 8, 1978 [DE] Fed. Rep. of Germany ..... 2815326

[51] Int. Cl.[3] ..... B65D 90/02

[52] U.S. Cl. ..... 220/1 R; 220/70; 220/72; 220/74; 264/534; 264/541

[58] Field of Search ..... 220/70, 72, 74, 83, 220/1 R, DIG. 1, 5 R; 215/1 C; 264/534, 541, 525

[56] References Cited

U.S. PATENT DOCUMENTS

| | | | |
|---|---|---|---|
| 2,975,931 | 3/1961 | Harrison | 220/74 X |
| 3,004,285 | 10/1961 | Hagen . | |
| 3,050,773 | 8/1962 | Hagen | 264/534 |
| 3,214,797 | 11/1965 | Ollier et al. . | |
| 3,250,429 | 5/1966 | Gesell | 220/83 X |
| 3,298,514 | 1/1967 | Erickson | 215/1 C |
| 3,342,915 | 9/1967 | Wanderer . | |
| 3,561,629 | 2/1971 | Turner | 215/1 C |
| 3,804,289 | 4/1974 | Churan | 220/72 X |
| 3,821,344 | 6/1974 | Peters . | |
| 3,825,145 | 7/1974 | Reynolds | 220/83 X |
| 3,843,005 | 10/1974 | Uhlig . | |
| 3,889,839 | 6/1975 | Simon et al. | 220/72 |
| 3,912,438 | 10/1975 | Padovani . | |
| 3,934,747 | 1/1976 | Needt . | |
| 3,938,687 | 2/1976 | Maier et al. | 220/5 R |
| 3,985,257 | 10/1976 | Shaffer et al. | 220/72 X |
| 4,094,432 | 6/1978 | Zilbert . | |

FOREIGN PATENT DOCUMENTS

| | | | |
|---|---|---|---|
| 967521 | 5/1975 | Canada | 220/72 |
| 992475 | 7/1976 | Canada | 220/72 |
| 2441987 | 3/1975 | Fed. Rep. of Germany | 220/75 |
| 7600621 | 5/1976 | Fed. Rep. of Germany . | |

*Primary Examiner*—Allan N. Shoap

*Attorney, Agent, or Firm*—Pennie & Edmonds

[57] ABSTRACT

An L-shaped roller chime is provided adjacent each end of a closed head drum. The drum is formed of a thermoplastic material and is blown into shape in an openable mold so that the drum has axially extending dividing seams. Each L-shaped chime has a first leg extending outwardly from the drum and a second leg extending generally perpendicularly to the first leg and in the axial direction of the drum. The depth of the groove formed by the first and second legs and the outer drum surface is uniform, however, the thickness of the first leg varies from a maximum at the dividing seams to a minimum intermediate the seams.

11 Claims, 5 Drawing Figures

ROLLER CHIMES FOR CLOSED HEAD DRUMS

CROSS-REFERENCE TO RELATED APPLICATION

U.S. Patent Application Ser. No. 884,397 filed Mar. 8, 1978 for ROLLER CHIMES FOR CLOSED HEAD DRUMS by Theo Hammes.

BACKGROUND OF THE INVENTION

The present invention is directed to a closed head drum made of thermoplastic material and blown into shape within an openable mold. The drum has roller chimes of L-shaped cross section which extend around the outer surface of the drum body adjacent the head end and the bottom end. The roller chimes are formed integrally in the drum body. The roller chimes in combination with the outer surface of the drum body form a recess or groove with the opening of the groove directed toward the adjacent end of the drum. The grooves provide engagement surfaces for a gripping and transporting tool.

As compared to drums in which prefabricated roller hoops are inserted into the blowing mold so that the hoops are welded to the drum when the extruded parison is inflated, drums incorporating roller chimes as described above have the advantage that production is much simpler. Since the roller chimes formed integrally with the drum body are component parts of the drum, they cannot be displaced during rough handling.

The blowing mold used for producing such closed head drums consists of two mold halves which are separable along a vertical plane, that is, the plane extending in the axial direction of the drum. The upper and lower region of each mold half is horizontally divided to provide mold parts which slide one into the other.

When the parison is lowered out of the extrusion head of the blowing machine, the mold halves are in the separated position so that the parison can enter into the opened blowing mold. At this time, the mold parts in each mold half which slide relative to one another are opened. After the parison is lowered in the axial direction of the drum into the mold, the two mold halves are closed. In the closed position, the mold halves clamp the previously extruded parison at what will be the head and bottom ends of the drum creating a seam across both clamped portions of the parison. The blowing process is then commenced. Molding apparatus of this type is conventional. See, for example, U.S. Pat. No. 3,985,257 for "Blow Molded Industrial Drum" and U.S Pat. No. 3,050,773 for "Process and Apparatus for Manufacturing Blown Articles". Air flowing in through a mandrel expands the parison so that it is pressed outwardly against the inner wall of the closed mold and, as a result, assumes the predetermined shape of the drum. With the upper and lower mold parts of each mold half disposed in an open position, the material of the parison enters into the recesses formed by the open mold parts. With such a mold construction, radially outwardly extending channels are formed on the container during the blow molding operation. These channels open toward the inside of the container.

Subsequently, the mold parts are moved relative to one another into a closed position. The mold parts which can be moved relative to one another are shaped to provide the roller chime configuration and the material of the channels pressed into the recesses provided by the mold parts forms the roller chimes when the mold parts are moved relative to one another. The roller chimes have an L-shaped cross section each with an outwardly extending horizontal web or leg and with a vertical leg extending from the outer end of the horizontal leg in either the upward or downward direction depending upon the location of the chimes.

The shape of the roller chime is of special significance. The gripping device for lifting and carrying the drum grasps with its tong arms under the horizontally outwardly projecting roller chime leg and behind the vertically extending leg. Accordingly, the vertical leg of the upper roller chime, that is, the chime adjacent the drum head, extends upwardly from the horizontal leg while the vertical leg of the lower roller chime, that is, the chime adjacent the bottom end of the drum, is directed downwardly from the horizontal leg. Due to the varying material distribution in the drum body, difficulties occur in the formation of the roller chimes. In the region of the dividing seams in the mold, the material of the extruded parison is doubled when the mold halves are moved to the closed position and the material has been squeezed into a clamped seam extending diametrically across the closed mold at both the top and bottom of the mold. During the blowing process, the parison is stretched and those regions which in a direction perpendicularly away from the squeezed seam become significantly thinner. In the formation of the roller chimes in the upper and lower displaceable parts of each mold half, different volumes of material are available. As a result, due to the larger amount of the material in the region of the mold dividing seams, the displaceable mold parts cannot close completely and, thus, a satisfactory formation of the roller chimes in the region of the thinner areas becomes impossible. Because of the gripping devices used in lifting and transporting the drums, a satisfactory formation of the roller chimes is required.

SUMMARY OF THE INVENTION

It is the primary object of the present invention to form roller chimes of L-shaped cross section which extend outwardly from and are formed out of the drum body and provide a uniformly shaped groove for gripping the drum taking into consideration the unequal material distribution within the parison as it is blown outwardly within the openable molds.

In accordance with the present invention, while the depth of the groove formed by the roller chime is uniform about the entire circumference of the drum, the thickness of a portion of the chime, and in particular the wall thickness of the horizontal leg decreases from the dividing seams in the mold for an angular extent of 90° until the horizontal leg thickness reaches a minimum corresponding to the thickness of the drum body and then increases steadily to the region of the next mold dividing seam. The horizontal legs of the roller chime adjacent the head end of the drum where the region of largest material accumulation occurs are widened, that is, in the radial direction from the drums, the providing indentations in the head end directed toward the interior of the drum.

For producing the desired horizontal leg thickness, the part of the mold which forms the outer surface of the horizontal leg has a wave-like contour with the wave troughs arranged in the region of a larger accumulation of the material and the wave crests located in the region of the lesser material accumulation. Accordingly, the movable mold parts of each mold half can be closed completely without pressing the larger material volume into the interior of the drum. Furthermore, the shape of the mold part forming the outer horizontal leg surface guarantees the uniform or constant height of the vertical leg of each roller chime around its circumference.

To enlarge the cooling surface and thereby reduce damaging shrinkage stresses in the regions of the larger material accumulation, at such locations the horizontal legs of the roller chimes are widened adjacent the head end of the drum by forming indentations into the head end with the indentations opening to the outer surface of the drum. The indentations are formed around and downwardly from the bungs located in the mold dividing seams. These bungs, in turn, direct additional material into the regions of the mold dividing seam when the blow mandrels are moved apart during the step of closing the blowing mold.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
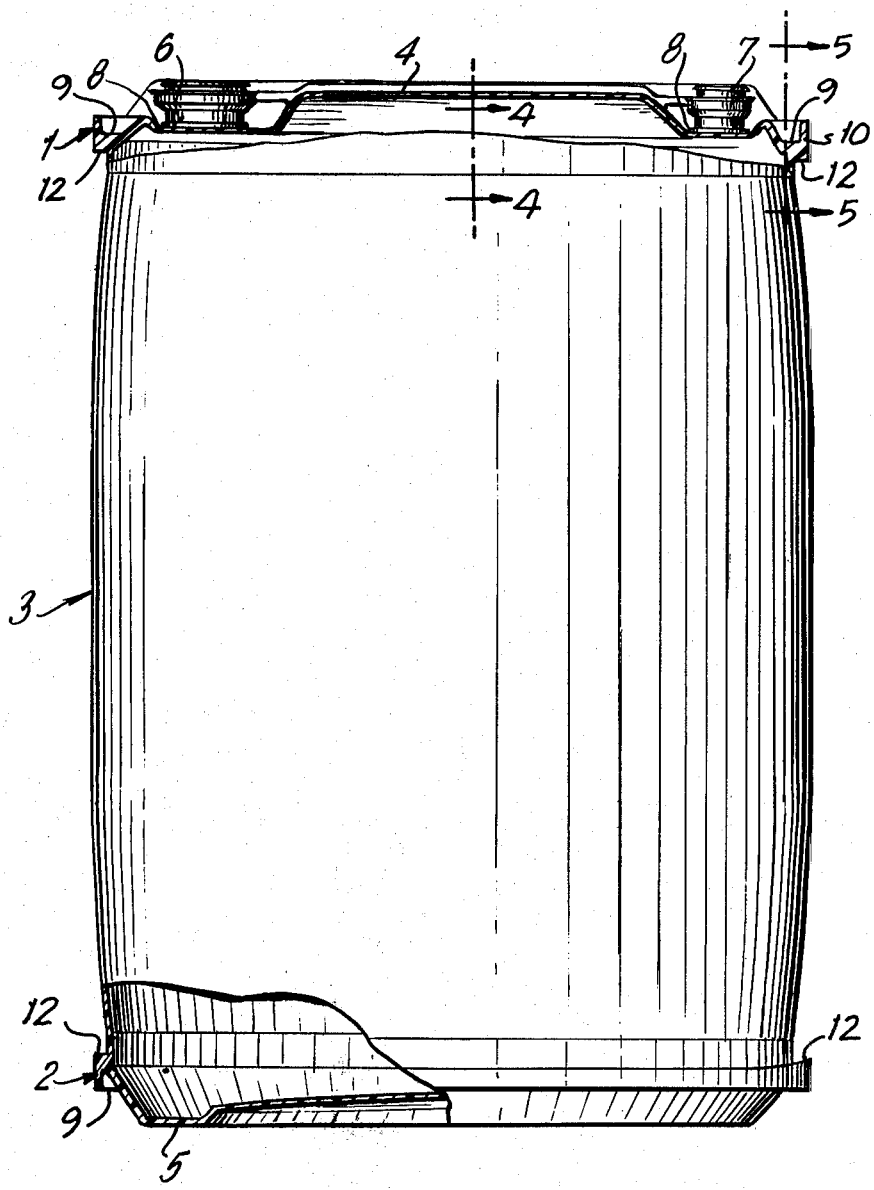
FIG. 1 is a side view of a closed head drum having a roller chime adjacent each of its head end and bottom end.

In FIG. 1 a closed head drum 3 is shown in the vertical position, that is, with its axis vertical. The drum body 3 is formed in a mold consisting of mold halves which can be moved between open and closed positions. Additionally, each mold half has mold parts movable in the axial direction of the drum. Roller chimes 1, 2 are formed radially outwardly from the drum body by moving the mold parts in the axial direction after the mold is closed and the parison of thermoplastic material is blown outwardly against the interior surfaces of the mold halves. Each of the roller chimes 1, 2, as viewed in FIG. 1, has a horizontally extending leg extending radially outwardly from the outer surface of the drum body 3 and a vertically extending leg in generally parallel relation with the axis of the drum and extending from the horizontal leg toward the adjacent end of the drum. In other words, the vertical leg of roller chime 1 extends toward the top or head end 4 of the drum while the vertically extending leg of roller chime 2 extends downwardly toward the adjacent bottom end of the drum.

As can be seen in FIG. 1, the head end 4 and bottom end 5 of the drum body each project axially beyond the roller chimes 1, 2 so that the roller chimes are protected when the drums are stacked. Bungs 6,7 are formed on the opposite sides of the drum head in recesses or indentations 8 formed into the head end.

Figure 4:
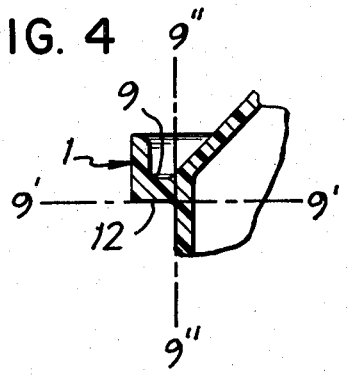
FIG. 4 is a cross-sectional view taken along lines 4—4 of FIG. 1.
Figure 5:
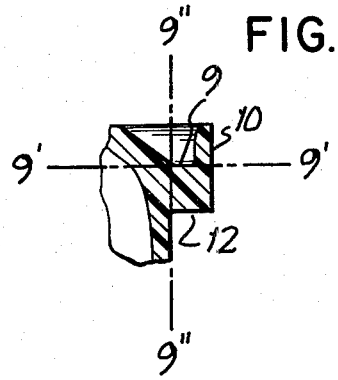
FIG. 5 is a cross-sectional view taken along lines 5—5 of FIG. 1.
Figure 2:
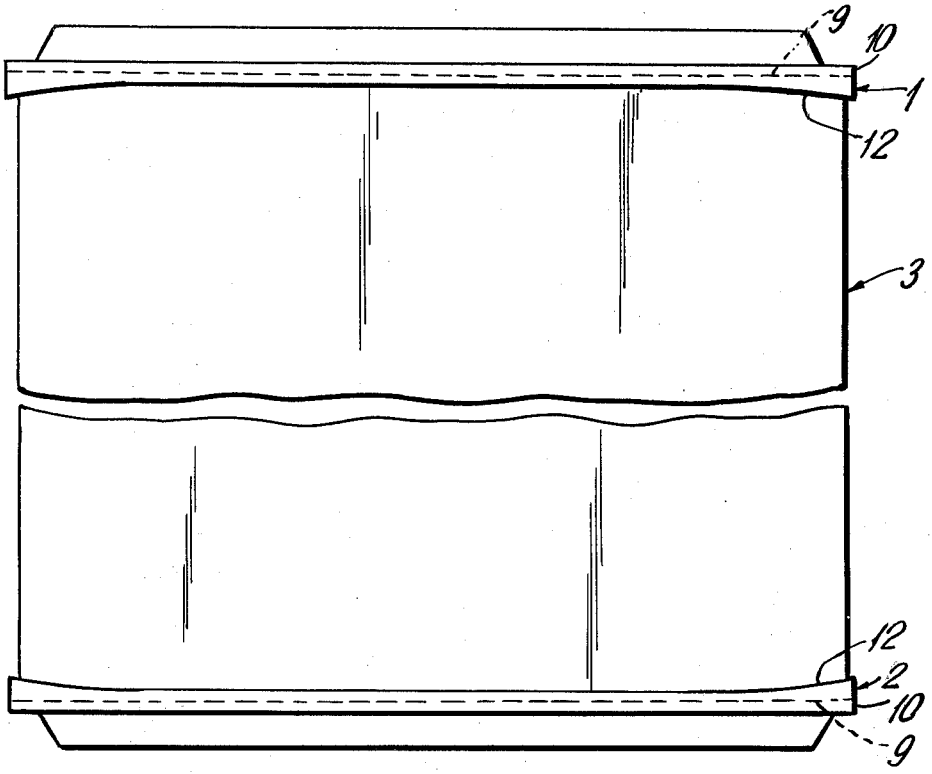
FIG. 2 is developed projection of a drum half as shown in FIG. 1 with the development illustrated in a simplified manner and in a reduced scale as compared to FIG. 1
Figure 3:
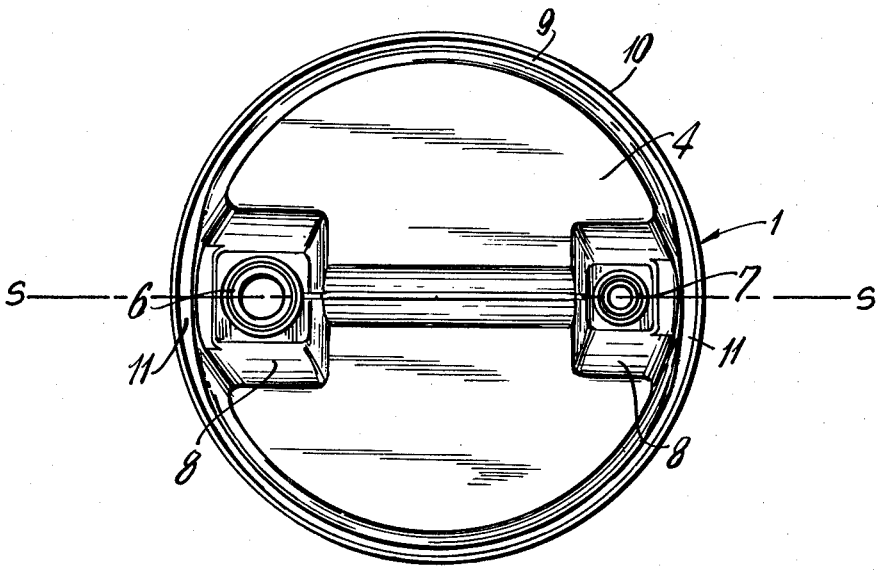
FIG. 3 is a top view of the closed head drum shown in FIG. 1 and also illustrated on a reduced scale.

In FIG. 2 which illustrates the development of one drum half extending between the mold dividing seams with the seams at the top and bottom of the drum, as formed by the closing of the mold halves on the tubular parison, lying in the plane of the paper. With reference to FIG. 3, the location of the seam at the top of the drum is shown by line S—S as extending diametrically thereacross. The roller chimes 1,2 have vertical legs 10; and the dotted lines 9 in FIG. 2 designate the face of the horizontal leg within the groove or recess formed by the roller chime and the adjacent surface of the drum body. In other words, as shown in FIG. 1 in the roller chime 1 the surface 9 faces upwardly while in the lower roller chime 2 the surface 9 faces downwardly. In FIGS. 4 and 5, the upper boundary of the horizontal leg including the portion which is disposed radially outwardly of the surface 9, is shown by the line 9′—9′ whereas its radial inner boundary is shown by the line 9″—9″. The vertical leg 10 of the chime thus sits on top of the horizontal leg at its radial outer end and extends transversely therefrom and generally in the same direction as the side wall of the drum. The solid line 12 designates the outside surface of the horizontal leg, that is, as shown in FIG. 1, the downwardly facing surface of the upper roller chime 1 and the upwardly facing surface of the lower roller chime 2. The outer surfaces 12 face toward the center of the drum. The diametrically opposite vertically extending lines on the left and right of the half drum body 3 in FIG. 2 are located at the mold dividing seams in which region is the largest accumulation of material in the roller chimes 1, 2. In accordance with the design of the surfaces of the blowing mold which define the roller chimes, the wall thicknesses of the horizontal legs of roller chimes 1, 2 decrease steadily from one mold dividing seam toward the center of the developed mold half where the wall thickness reaches a minimum and then steadily increases to the opposite end mold dividing seam. The chime at the point midway between mold dividing seams where its thickness is at a minimum is shown in cross-section in FIG. 4 whereas the chime at the mold dividing seams where the thickness is at a maximum is shown in FIG. 5.

The height of the vertical legs 10 projecting upwardly or downwardly from the inner surface 9 of the horizontal legs is constant around the entire circumference of the drum, the bottom of the grooves formed by the roller chimes and the outer surface of the drum body is indicated by the surfaces 9 of the horizontal legs. If the entire development of the drum were illustrated, a wave-like pattern of the lower face of the horizontal leg of the upper roller chime 1 or the upper face of the horizontal leg of the lower roller chime 2 would result and viewing the upper chime 1, the wave troughs would be located in the region of the mold dividing seams. Similarly, the wave crests would be located in the regions of the least accumulation of material, that is, where the parison is subjected to the greatest stretching action when it is blown outwardly against the mold surface.

In FIG. 3, surface 9 of the horizontal leg of the upper roller chime 1 has a portion 11 of greater radial dimension in the region of the largest accumulation of material adjacent the bungs 6,7 due to the formation of the recesses or indentations 8 directed into the drum. Thus, the annular recess has a greater radial dimension in these regions.

While specific embodiments of the invention have been shown and described in detail to illustrate the application of the inventive principles, it will be understood that the invention may be embodied otherwise without departing from such principles.

What is claimed is:

1. A closed head drum formed of a thermoplastic material parison blown within a mold openable horizontally along a vertical plane and comprising:
   (a) a head end;
   (b) a bottom end spaced from said head end;
   (c) a side wall formed integrally with and extending between said head and bottom ends, said said wall forming the lateral closure of the drum and having an increased wall thickness on diametrically opposite sides thereof; and
   (d) at least one roller chime formed integrally with and extending circumferentially around said side wall, said roller chime being L-shaped and comprising:
      (1) a first leg extending radially outwardly from said side wall,
      (2) a second leg extending from and transversely of the radially outer end of said first leg so that said second leg extends generally in the same direction as said side wall,
      (3) said second leg being spaced radially outwardly from the outer surface of said side wall and forming, in combination with said side wall and said first leg, an annular recess extending circumferentially around the drum, and
      (4) a portion of said chime having a variable thickness with the maximum thickness of said portion being located at said diametrically opposite sides and the minimum thickness thereof located between said diametrically opposite sides.

2. A closed head drum, as set forth in claim 1, wherein:
   (a) the first leg of said chime has said variable thickness; and
   (b) the minimum thickness location of said first leg is equidistantly spaced from said diametrically opposite sides.

3. A closed head drum, as set forth in claim 1, wherein:
   (a) said chime is located adjacent said head end and spaced axially therefrom in the direction toward the bottom end of the drum; and
   (b) at least one axially depressed indentation is formed in said head end adjacent to and opening toward the circumferential periphery thereof.

4. A closed head drum, as set forth in claim 3, wherein:
   (a) the annular recess of said roller chime has a greater radial dimension in the area adjacent said indentation than its radially extending dimension for the remaining circumferential extent of said chime.

5. A closed head drum, as set forth in claim 3, wherein:
   (a) two said chimes are formed in said side wall, one adjacent said head end and the other adjacent said bottom end; and
   (b) two said indentations are formed in said head end with said indentations located at said diametrically opposite sides of the drum.

6. A closed head drum, as set forth in any one of claims 1–5, wherein:
   (a) said second leg of each said chimes has the same height from said first leg for the circumferential extent of said annular recess.

7. A closed head drum, as set forth in claim 1, wherein:
   (a) the chime is located adjacent one end of the drum; and
   (b) the bottom of the annular recess as defined by the surface of the first leg of the chime facing the adjacent one end of the drum is at a uniform distance from said one end.

8. A closed head drum, as set forth in claim 7, wherein:
   (a) the height of the second leg of the chime as measured from the bottom of the annular recess is uniform around the entire circumferential extent of said chime.

9. A closed head drum, as set forth in claim 7, wherein:
   (a) the first leg of the chime extends radially outwardly from the side wall of the drum by a uniform distance as measured around the entire circumferential extent of the chime.

10. A closed head drum, as set forth in claim 9, wherein:
   (a) the surface of the first leg of the chime facing the other end of the drum varies in its distance from the bottom of the annular recess to provide said variable thickness.

11. A closed head drum, as set forth in any one of claims 1–5 or 7–10, wherein:
   (a) the head and bottom ends of the drum have a molding seam extending diametrically thereacross; and
   (b) the areas of maximum increased thickness of the chimes are located at the diametrically opposite ends of the molding seams.

* * * * *

UNITED STATES PATENT AND TRADEMARK OFFICE

CERTIFICATE OF CORRECTION

PATENT NO. : 4,228,911

DATED : October 21, 1980

INVENTOR(S) : Theo Hammes

It is certified that error appears in the above-identified patent and that said Letters Patent are hereby corrected as shown below:

Column 2, line 26, "which in a" should read --which move in a--.

Signed and Sealed this

*Sixth* Day of *January 1981*

[SEAL]

*Attest:*

SIDNEY A. DIAMOND

*Attesting Officer*

*Commissioner of Patents and Trademarks*